US006076541A

United States Patent [19]

Pozniak et al.

[11] Patent Number: 6,076,541

[45] Date of Patent: Jun. 20, 2000

[54] DISPENSING SYSTEM AND METHOD FOR DISPENSING AN AQUEOUS SOLUTION

[76] Inventors: Peter M. Pozniak, 5004 Williams Rd., San Jose, Calif. 95129; Duy Khanh Trang, 1622 Stanwich Rd., San Jose, Calif. 95131; Benjamin R. Roberts, 820 Laverne Way, Los Altos, Calif. 94022

[21] Appl. No.: 08/979,496

[22] Filed: Nov. 26, 1997

[51] Int. Cl.[7] ..... F04F 1/06

[52] U.S. Cl. ..... 137/14; 137/208; 137/209; 137/210

[58] Field of Search ..... 137/208, 209, 137/210, 211, 14

[56] References Cited

U.S. PATENT DOCUMENTS

| | | | |
|---|---|---|---|
| 4,223,324 | 9/1980 | Yamamori et al. . | |
| 4,390,126 | 6/1983 | Buchholz et al. | 137/209 X |
| 4,545,801 | 10/1985 | Miyajiri et al. | 137/209 X |
| 5,148,945 | 9/1992 | Geatz | 137/208 X |

FOREIGN PATENT DOCUMENTS

| | | |
|---|---|---|
| 2558737 | 4/1985 | France . |
| WO98 00676 | 1/1998 | WIPO . |

OTHER PUBLICATIONS

Patent Abstracts of Japan, vol. 6 No. 127, Published Mar. 30, 1982.

*Primary Examiner*—Gerald A. Michalsky
*Attorney, Agent, or Firm*—David M. Rosenblum; Salvatore P. Pace

[57] ABSTRACT

A system and method for dispensing an aqueous solution to one or more points of use is provided with one or more pressure vessels that are adapted to be charged with pressurized gas to drive the aqueous solution on to the point or points of use. A humidifier is also employed to humidify the pressurized gas to at least inhibit the pressurized gas from evaporating the moisture from the aqueous solution. In such manner, changes to the make up of the aqueous solution are avoided. Such changes can produce caking and/or changes in chemical properties found in pressure vessels used in dispensing slurries.

5 Claims, 1 Drawing Sheet

DISPENSING SYSTEM AND METHOD FOR DISPENSING AN AQUEOUS SOLUTION

BACKGROUND OF THE INVENTION

The present invention relates to a dispensing system and method in which an aqueous solution is dispensed from pressure vessels charged with a pressurized gas to drive the aqueous solution to one or more points of use. More particularly, the present invention relates to such a system and method in which the pressurized gas is humidified to at least inhibit the pressurized gas from taking up moisture from the aqueous solution.

Liquids made up of aqueous solutions of chemicals are dispensed from a variety of different devices that incorporate pressure vessels to drive the liquid to an end point of use. The pressure vessel is charged with a pressurized gas such as nitrogen to provide the motive force to drive the chemical to the intended point of use. An example of such device can be found in U.S. Pat. No. 5,148,945. In this patent, multiple pressure vessels are used to produce a continuity in the delivery of the liquid being dispensed. Other systems utilize only a single pressure vessel to accomplish the dispensing.

Generally, dry, ultra-high purity nitrogen is used to charge the pressure vessels to prevent contamination of the liquid chemical to be dispensed. However, dry nitrogen will over time pick up moisture from the liquid and change the character of the solution. Thus, when slurries are being dispensed, such take up of moisture produces unwanted drying and caking of the slurry within the pressure vessels. This caking is to be avoided, especially where the end use is a semiconductor polishing or planarization tool because the particles created can cause wafer defects.

SUMMARY OF THE INVENTION

The present invention provides a system to dispense an aqueous solution to at least one point of use. The system comprises a device to dispense the aqueous solution to the at least one point of use. The device has at least one pressure vessel adapted to be charged with a pressurized gas to drive the aqueous solution to the at least one point of use. A humidifier is connected to the device to humidify the pressurized gas to at least inhibit the pressurized gas from evaporating moisture from the aqueous solution.

In another aspect the present invention provides a method of dispensing an aqueous solution to at least one point of use. In accordance with the method, the aqueous solution is dispensed to the at least one point of use from a device having at least one pressure vessel adapted to be charged with a pressurized gas to drive the aqueous solution to the at least one point of use. The pressurized gas is humidified prior to charging the at least on pressure vessel therewith to at least inhibit the pressurized gas from evaporating the moisture from the aqueous solution.

If the pressurized gas is humidified, it is less prone to evaporate moisture from the aqueous solution. This prevents the aqueous solution from forming either unwanted deposits upon evaporation of the moisture or from changing the character of the solution due to a change in the molar concentration of its constituents.

BRIEF DESCRIPTION OF THE DRAWINGS

While the specification concludes with claims distinctly pointing out the subject matter that Applicants regard as their invention, it is believed the invention will be better understood when taken in connection with the accompanying drawings in which the sole Figure is an apparatus for carrying out a method in accordance with the present invention.

DETAILED DESCRIPTION

Figure 1:
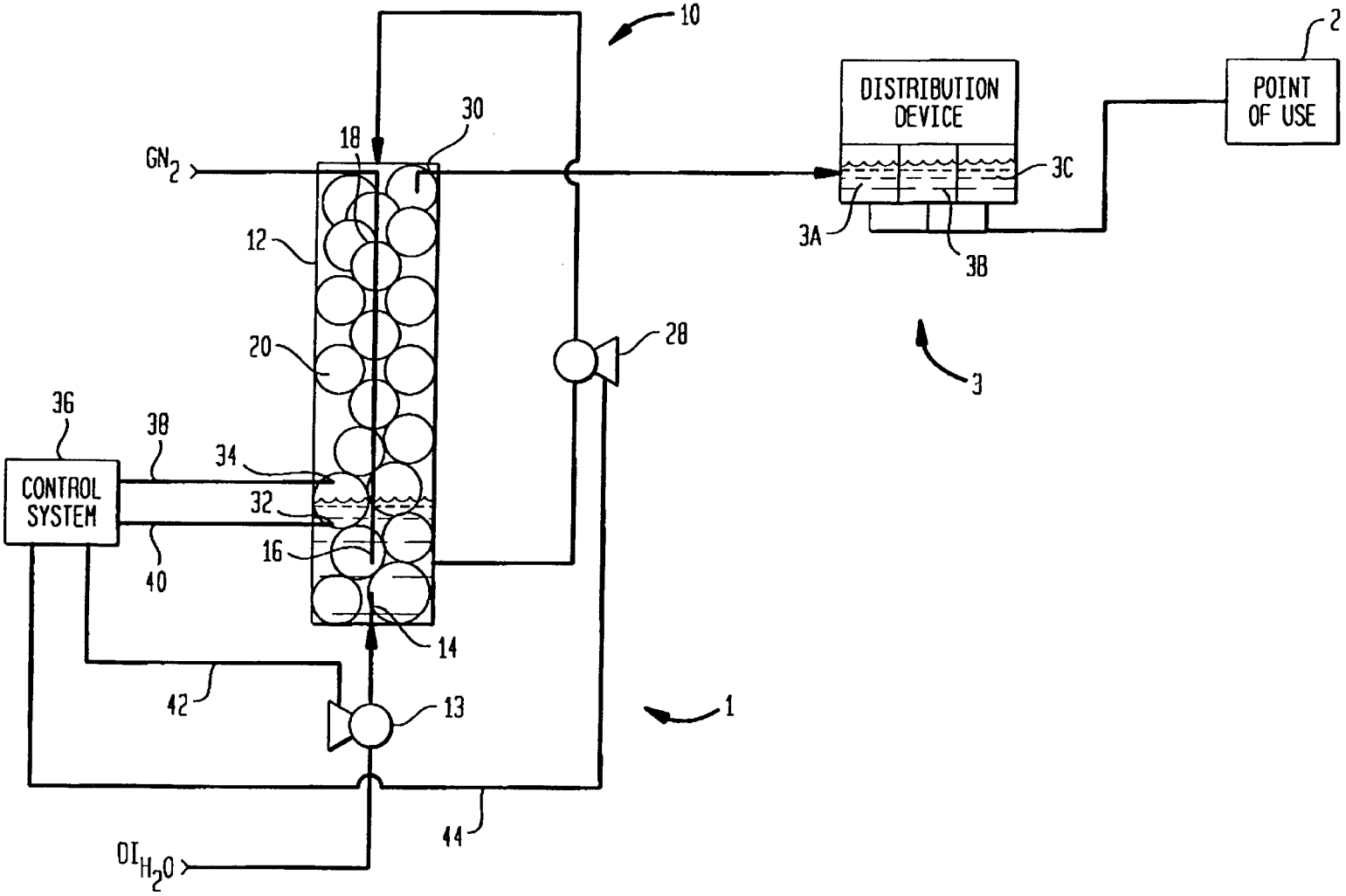

With reference to the Figure, a dispensing system 1 in accordance with the present invention is illustrated. Dispensing system 1 is designed to dispense an aqueous solution such as a slurry to a point of use 2 which can be a chemical/mechanical planarization tool. The slurry is dispensed to point of use 2 by way of a dispensing apparatus 3 provided with pressure vessels 3A, 3B, and 3C. Pressure vessels 3A, 3B and 3C are designed to be charged with a pressurized gas to drive the aqueous solution to point of use 2. It is understood that the dispensing apparatus 3 could be any type of pressure driven device and could in fact utilize a single pressure vessel.

A humidifier 10 supplies the pressurized gas to dispensing device 3 so that pressure vessels 3A, 3B, and 3C are charged with a pressurized gas that is humidified to an extent that it is not supersaturated. This is important because if supersaturated, the liquid could come out of solution to contaminate the aqueous solution to be dispensed.

Humidifier 10 includes a column 12. If deionized water is not available at sufficient pressure, a pump 13 can be provided to pressurize a stream of deionized water. Column 12 has an inlet 14 to receive the deionized water and a pressurized gas inlet 16 to receive the pressurized gas which, in case of semiconductor fabrication, could be ultra-high purity nitrogen in a dry state. As illustrated, pressurized gas inlet 16 is provided with a conduit 18 that penetrates column 12 and a packed bed 20 contained within column 12.

Gaseous nitrogen enters column 12 through pressurized gas inlet 16, bubbling up through the pressurized de-ionized water. The nitrogen in the course of bubbling up the deionized water becomes supersaturated. The flooded packing of packed bed 20 breaks the incoming gas stream into small bubbles increasing mass transfer. The unflooded packing located above the splash level strips excess water from the gas resulting in a desired near saturated condition of the gas by the time of its discharge from column 12 through gas outlet 30.

As illustrated, a pump 28 can be provided to pump de-ionized water so that the deionized water will also descend through the packing and thus produce a greater mass transfer between the pressurized gas and the film formed on the elements of packed bed 20.

The degree to which humidification occurs within the pressurized nitrogen gas to be supplied is dependent upon the height of liquid. Practically for any size or type of packed bed employed, the liquid height is experimentally determined. Thus, the level must be controlled. This is done in apparatus 1 by means of a lower liquid level liquid detector 32 and a higher liquid level detector 34. If the liquid level falls below the level detector 32, pump 13 is commanded to operate by a control system 36 (either an analog or digital system). If the liquid level reaches level detector 34, pump 13 immediately shuts down to prevent liquid from being expelled into pressure vessels 3A, 3B, and 3C of dispensing device 3. If pressurized deionized water is available, pump 13 could be replaced by a valve. As illustrated, conductors 38 and 40 connect level detectors 32 and 34 to control system 36. An electrical conductor 42 also connects pump 13 to control system 36.

Control system 36 can also be designed to control the recirculation rate of liquid being pumped by pump 28. This will also control the humidity of the humidified pressurized gas being sent to dispensing device 3 by adjusting the amount of water in contact with the gas in a counter-current flow. To this end, the required setting can be experimentally determined. An electrical conductor 44 can be provided to connect pump 28 to control system 36.

By way of an example, a column 12 was constructed in order to supply an adequate amount of nitrogen having a humidity of about 95%, to dispense about 30 Liters per minute of slurry at 20° C. and at a pressure of between about 276 and about 483 Kps. Such column has a packed bed 20 fabricated from BIOX SUPER packing obtained from AQUA CRAFT INC., P.O. Box 653, San Carlos, Calif. 94070. The packed bed 20 was approximately 10 cm. in diameter by about 50 cm. in height. The packing of packed bed 20 was wetted by deionized water having a volume in a range of between about 1.6 and about 2.6 liters.

While the present invention has been described with reference to a preferred embodiment, as will occur to those skilled in the art, numerous changes, additions, and omissions, may be made without departing from the spirit and scope of the present invention.

We claim:

1. A system to dispense an aqueous solution to at least one point of use, said system comprising:

a device to dispense said aqueous solution to said at least one point of use, said device having at least one pressure vessel adapted to be charged with a pressurized gas to drive said aqueous solution to said at least one point of use; and a humidifier connected to said device to humidify said pressurized gas to at least inhibit said pressurized gas from evaporating moisture from said aqueous solution.

2. The system of claim 1, wherein said humidifier includes:

a pump to pressurize a stream of de-ionized water; and a column having, a deionized water inlet to receive said deionized water, a pressurized gas inlet to receive said pressurized gas, a humidified gas outlet and connected to said device, and a packed bed located between said gas inlet and said humidified gas outlet so that said pressurized gas bubbles up through said deionized water to become humidified and interacts with said packed bed, thereby to ensure said pressurized gas is not supersaturated after having been humidified.

3. The system of claim 2, wherein said humidifier further includes a recirculation pump connected to said column so that a stream of said de-ionized water is circulated to descend through said packed bed.

4. A method of dispensing an aqueous solution to at least one point of use, said method comprising:

dispensing said aqueous solution to said at least one point of use from a device having at least one pressure vessel adapted to be charged with a pressurized gas to drive said aqueous solution to said at least one point of use; and humidifying said pressurized gas prior to charging said at least one pressure vessel therewith to at least inhibit said pressurized gas from evaporating moisture from said aqueous solution.

5. The method of claim 4, wherein said pressurized gas is humidified by bubbling said pressurized gas through a column containing de-ionized water to humidify said pressurized gas and a packed bed to ensure said pressurized gas is not supersaturated after having been humidified.

* * * * *